United States Patent [19]

Nakano et al.

[11] Patent Number: 4,764,746

[45] Date of Patent: Aug. 16, 1988

[54] CIRCUIT BREAKER

[75] Inventors: Kunimitsu Nakano, Taishibashi; Takeyasu Katou, Seto; Mitsuaki Sakakibara, Aichi, all of Japan

[73] Assignee: Matsushita Electric Works, Ltd., Osaka, Japan

[21] Appl. No.: 52,943

[22] Filed: May 22, 1987

[30] Foreign Application Priority Data

May 26, 1986 [JP] Japan ..... 61-120648
Sep. 25, 1986 [JP] Japan ..... 61-226959

[51] Int. Cl.[4] ..... H01H 71/16
[52] U.S. Cl. ..... 337/66; 337/70
[58] Field of Search ..... 337/66, 56, 70, 72, 337/73, 75, 68

[56] References Cited

U.S. PATENT DOCUMENTS 2,961,513 11/1960 Wood ..... 337/66
4,092,623 5/1978 Kirkup ..... 337/66

*Primary Examiner*—H. Broome
*Attorney, Agent, or Firm*—Armstrong, Nikaido, Marmelstein & Kubovcik

[57] ABSTRACT

A circuit breaker utilizes an elongated contact spring member which extends along the length of a breaker housing in an inclined relation with respect to the longitudinal axis of the housing. The contact spring member is fixed at its one end and carries on the other end a movable contact engageable with a stationary contact. The contact spring member is self-biased in the direction of opening the contacts and is operatively connected to an actuator which is slidably received in the housing for movement between an outward and inward positions. The inward sliding movement of the actuator is translated into the contact closing movement of the contact spring member with the attendant deflection of the contact spring member against its bias. The energy accumulated in the deflected contact spring member in the closed position is liberated in response to a fault current condition to drive the actuator in such a manner as to pivot the actuator about a pivot axis adjacent its fixed end under the bias of the contact spring member. In this manner, the tripping of the contacts can be effected by making the most of the contact spring member.

8 Claims, 8 Drawing Sheets

CIRCUIT BREAKER

BACKGROUND OF THE INVENTION

1. Field of the Invention

The present invention relates to an electric circuit breaker, and more particularly to such a circuit breaker of the type suitable as a substitution for a conventional fuse holder.

2. Description of the Prior Art

In the field of the electric circuit breaker, there has been a known practice to encase a breaker assembly in a housing shaped substantially cylindrically and dimensioned selectively so that the circuit breaker has the same external appearance as a conventional elongated fuse holder. Prior breakers of this type can be found in U.S. Pat. Nos. 4,068,203, 4,123,737, 4,363,016 and 4,518,943, each of which discloses the use of a snap-acting bimetallic strip carrying thereon a movable contact in cooperation with a spring loaded insulation screening board. The insulation screening board is latched directly by the movable contact in closed position against the spring bias in the normal operating condition. The insulation screening board is unlatched to move between the separated contacts for insulation therebetween in response to fault current condition. In such prior breakers, since the snap-acting bimetallic strip is self-biased in the direction of closing the contact and operates to latch in the screen board against the spring bias by engaging the movable contact thereon with the screening board, the bimetallic strip receives constant spring force through the screening board which may distort or at least upset the heat responsive characteristics of the bimetallic strip after an extended service life, eventually resulting in unreliable fault-current responsive tripping. This poses a critical problem for the breaker, in addition to that the screening board itself makes the assembly of the breaker complicated. Another prior circuit breaker is shown in U.S. Pat. No. 4,048,608 in which a contact actuator is latched by a bimetallic strip formed separately from the contacts. However, the contact actuator is operatively connected to a movable contact through a rather complicated and space-consuming mechanism including an eccentric coupling, which inhibits the breaker from being made compact enough to be substituted for the conventional fuse holder.

SUMMARY OF THE INVENTION

In view of the above, the present invention is contemplated to provide an improved electronic circuit breaker having an effective arrangement of the constituent parts thereof for compact and elongate housing designing purpose. A circuit breaker in accordance with the present invention comprises a housing having a longitudinal axis, contact means within the housing, and an elongated contact spring member mounted within the housing with its one end fixed and with the other end defining a contact end acting on the contact means. The contact spring member extends in an inclined relationship with respect to the longitudinal axis of the housing and self-biased to move the contactor end in the direction of opening the contact means. Cooperative with the contact spring means is an actuator which is slidably received in the housing for movement along the longitudinal axis between an outward position and an inward position. The actuator is formed at its inner end with an operator which abuts slidably on the contact spring member so as to flex the spring member against its bias into a contact closing position as translating the inward sliding movement of the actuator into the flexing movement of the spring member. The actuator is pivotably supported at the other end so as to be counter-driven by the bias of the contact spring member for pivotal movement about a pivot axis into a set position while keeping the contact means closed. A latch means is provided to latch the actuator in its set position against the bias of the spring member. Operatively connected to the latch means is fault current responsive trip means which, in response to a fault current condition, causes said latching means to unlatch the actuator, permitting the actuator to pivot about the pivot axis under the bias of the contact spring member in the direction of liberating it into a tripped position where it is relaxed to open the contact means. With this provision of the contact spring members extending in an inclined relation with respect to the sliding travel path of the actuator and being self-biased in the direction of opening the contacts, the actuator can make the use of the counter spring force to trip the actuator into the contact open position in addition to that the actuator can be closely disposed along the length of the contact spring member, which contribute to making the breaker at a reduced number of parts and in a compact design particularly with respect to the directions perpendicular to the length of the breaker. Also with the use of the inclined and elongated contact spring member, the actuator slidably engaged therewith is able to have a longer travel distance between the positions of closing and opening the contacts for reliable contact closing and opening.

Accordingly, it is a primary object of the present invention to provide a circuit breaker which is capable of being made compact at a reduced number of parts suitable as a substitution for the conventional fuse holder.

The pivotal movement of the actuator permits the contact separation under the urgence of the contact spring means without accompanying the sliding movement of the actuator, enabling the trip-free contact opening operation in a circumstance where the actuator is inhibited from sliding outwardly.

In preferred embodiments, the contact spring member is formed at its free end with a movable contact engageable with a stationary contact fixed in the housing. This is particularly advantageous in reducing the number of parts since the contact spring member alone serves to carry the movable contact plus to accumulate the tripping force itself as it is flexed into the contact closing position.

The fault current responsive trip means preferably comprises a bimetallic strip which is fixed at its one end with its plane disposed in parallel relation with the plane in which the actuator pivots about the pivot axis. The bimetallic strip has at the other free end a latch pin which projects perpendicularly to the plane of the bimetallic strip for such a latching engagement with the actuator that the latching force resulting from the bias of the contact spring member applies to the bimetallic strip substantially in the widthwise direction of the bimetallic strip. In view of the fact that the widthwise direction of the bimetallic strip will exhibit stronger resistance against the deflection than the other directions, the above latching engagement is most advantageous in preventing the undesired deflection and maintaining the characteristic of the bimetallic strip consistent.

It is therefore another object of the present invention to provide a circuit breaker in which the bimetallic strip can be free from being subjected to undesirable deflection or distortion, maintaining its heat responsive operation reliable.

The actuator is preferably formed adjacent the latch pin with a sloping guide edge which defines therebehind a shoulder for latching engagement with the latch pin. The sloping guide edge is cooperative with the latch pin to smoothly guide the actuator in its movement to the inward position for stable contact closing action, which is therefore a further object of the present invention.

Formed with the operator is a pilot projection which is in sliding engagement with a guide slit formed lengthwise in the contact spring member for positively guiding the operator along the length of the contact spring member as the actuator is moved from the outward position to the inward or set position. In this manner, the pilot extension serves to eliminate the fluttering of the actuator in its sliding movement, which is therefore a further object of the present invention.

In a preferred form, the actuator is connected to the one end of the return spring means at a point which is in alignment with the shoulder and the pilot extension. With this arrangement, the actuator receives the forces from the return spring, the contact spring, and the latch pin, all on the lengthwise axis of the actuator for assuring consistent and reliable actuator operation.

It is therefore a still further object of the present invention to provide a circuit breaker in which the actuator is capable of being stably mobilized.

These and other objects of the present invention can be appreciated more from the following detailed description when taken in conjunction with the attached drawings.

DETAILED DESCRIPTION OF THE PREFERRED EMBODIMENTS

Figure 1:
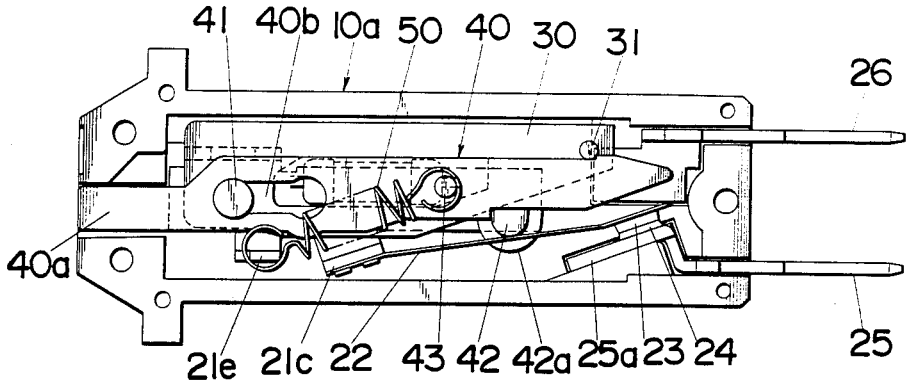
FIG. 1 is a longitudinal sectional view of a circuit breaker in the contact closed position according to a first preferred embodiment of the present invention with the half of its housing removed.
Figure 2:
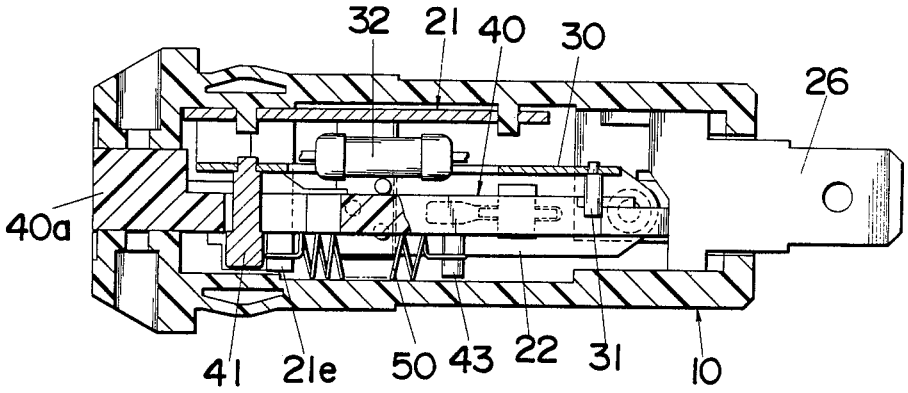
FIG. 2 is a top sectional view of the circuit breaker.
Figure 3:
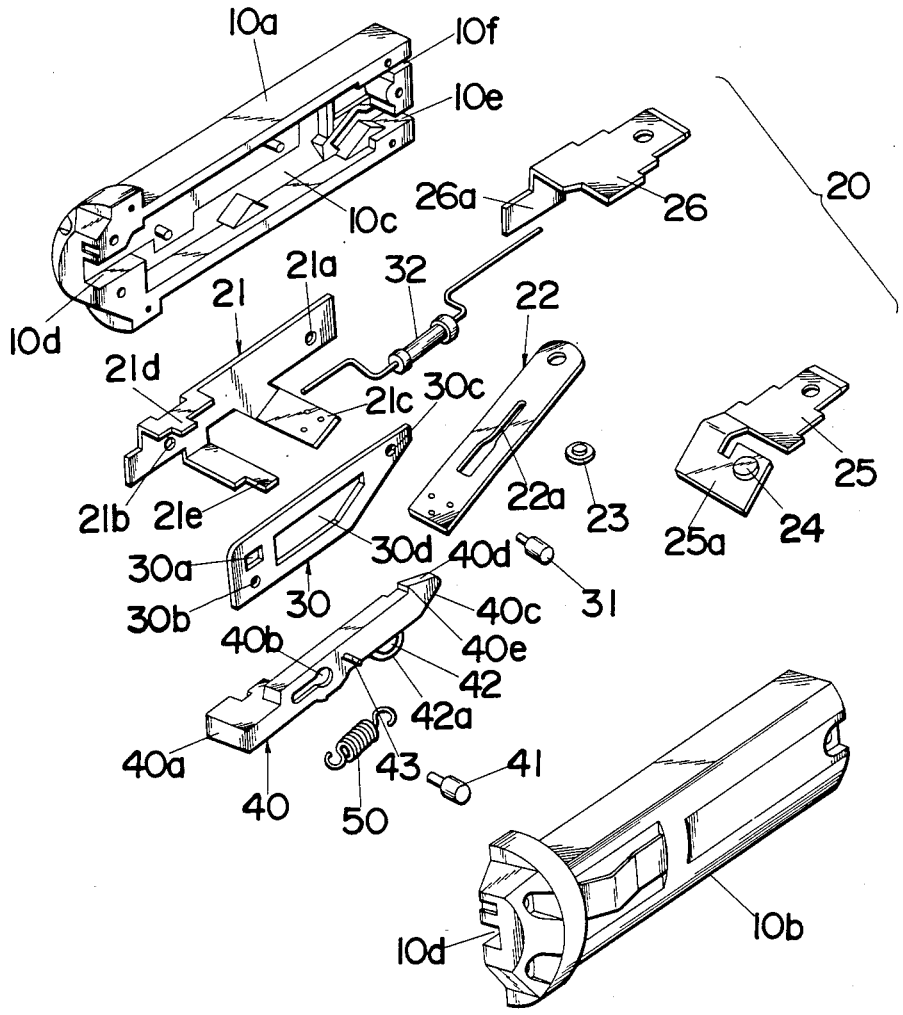
FIG. 3 is an exploded perspective view of the circuit breaker.

Referring firstly to FIGS. 1 to 3, the circuit breaker includes an elongated housing 10 having a longitudinal axis which is molded from an electrically insulating plastic material to have its substantial body shaped generally cylindrically. The housing 10 is composed of a pair of halves 10*a* and 10*b* which cooperate to define therebetween an elongate cavity 10*c*, and is configured to have an opening 10*d* at its front end and a pair of spaced slot-like openings 10*e* and 10*f* at its rear end. Received in the cavity 10*c* is an electrically conductive contact assembly 20 consisting of a base frame 21, an elongate contact spring member 22 having its one front end fixed to the base frame 21 and carrying a movable contact 23 on the rear end, and a stationary contact 24 disposed in a facing relation with the movable contact 23. The stationary contact 24 is mounted on an internal extension 25*a* of a first terminal 25 trap mounted through the opening 10*e*, while the movable contact 23 is electrically connected by way of the contact spring member 22, the base frame 21 and a heater resistor 32 to an internal extension 26*a* of a second terminal 26 also trap mounted through the opening 10*f* of the housing 10. The first and second terminals 25 and 26 are configured to protrude from the rearmost portion of the housing 10 and defining a pair of insertion blades to be inserted in a correspondingly dimensioned receptacle for electrical connection of the circuit breaker to a main operating circuit. The contact spring member 22 is operatively connected to an actuator 40 for contact closing and opening. A bimetallic strip 30 is also operatively connected to the contact spring member 22 through the actuator 40 for trip opening of the contacts 23 and 24 in response to a fault current condition.

Referring in detail to the construction of the contact assembly 20, the base frame 21 has a pair of through holes 21*a* and 21*b* by means of which the base frame 21 is fixedly mounted within the half 10*a* of the housing 10. Also formed with the base frame 21 are three lugs 21*c*, 21*d* and 21*e* all extended in the same direction as best shown in FIGS. 2 and 3. The lug 21*c* is laterally extended at the lower middle in the cavity 10*c* for electrical and mechanical connection to the contact spring member 22. The contact spring member 22 extends backwardly upwardly in an inclined relation with the longitudinal axis of the housing 10 and carries the movable contact 23 on the lower surface of its free end. The contact spring member 22 is self-biased in the direction of separating the movable contact 23 away from the stationary contact 24.

The lug 21*d* at the upper front of the base frame 21 is press fitted in a hole 30*a* formed in one longitudinal end of the bimetallic strip 30 for supporting the bimetallic strip 30 in cantilever fashion. The bimetallic strip 30 thus cantilevered at its one end extends lengthwise in generally parallel relation with the base frame 21 and the contact spring member 22, and will deflects laterally toward the base frame 21 and away from the contact spring member 22 upon being heated by the heater resistor 32, which is received in a lengthwise slot 30*d* in the middle of the bimetallic strip 30. The heater resistor 32 has its ends electrically and mechanically connected to a front portion of the base frame 21 and the internal extension 26*a* of the second terminal 26 respectively, so that the electrical path of the breaker is completed from the first terminal 25, through stationary contact 24, movable contact 23, contact spring member 22, base frame 21, heater resistor 32 to the second terminal 26. Formed in the free or rear end of the bimetallic strip 30 is a through hole 30*c* for connection with a latch pin 31 extending laterally toward the contact spring member 22.

Figure 4:
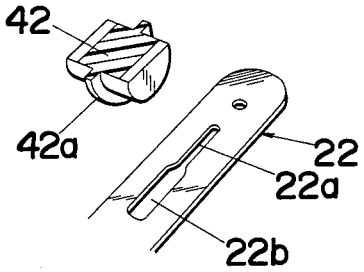
FIG. 4 is a fragmental perspective view of the portion of a spring means and an associated part employed in the circuit breaker.

Upwardly and forwardly of the contact spring member 22, there is disposed the actuator 40 which is elongated and slidably received in the cavity 10*c* of the housing 10. The actuator 40 defines at its front end a push button portion 40*a* which is received in the opening 10*d* of the housing 10 and extendable out therethrough. In the middle of the actuator 40 there is formed a lengthwise slot 40*b* for receiving therethrough a pivot pin 41 which extends transversely of the actuator 40 with its end fixed into a hole 30*b* in the bimetallic strip 30. The pivot pin 41 limits the sliding movement of the actuator 40 along the longitudinal axis of the housing 10 and allows the actuator 40 to pivot thereabout within a limited angle. One end of the slot 40*b* is enlarged to allow the insertion therethrough of the enlarged head of the pivot pint 41. The actuator 40 can be thus assembled afterwards on the base frame 21 by way of the bimetallic strip 30. The rear end of the actuator 40 defines a tapered section with an upwardly sloping edge 40*c* and a downwardly sloping edge 40*d*. Forwardly of the upwardly sloping edge 40*c* there is formed integral operator bump 42 of semi-circular profile which is in constant slidable engaging relation with the contact spring member 22. The operator bump 42 has its middle portion provided with a pilot projection 42*a* which is slidably fit in a lengthwise slit 22*a* formed in the middle of the contact spring member 22 as best shown in FIG. 4. The slit 22*a* has a width wider at the front end 22*b* than at the rear for facilitating smooth and reliable introduction of the pilot projection 42*a* into the slit 22*a*. The actuator 40 has at its middle portion a lateral pin 43 extending transversely of the actuator 40 for hooking engagement with one end of a return coil spring 50 which has the other end hooked to the lug 21*e* of the base frame 21 for urging the actuator 40 forwardly. The inner end of the downwardly sloping edge 40*d* is notched to define thereat a shoulder 40*e* for latching engagement with the latch pin 31.

Figure 5:
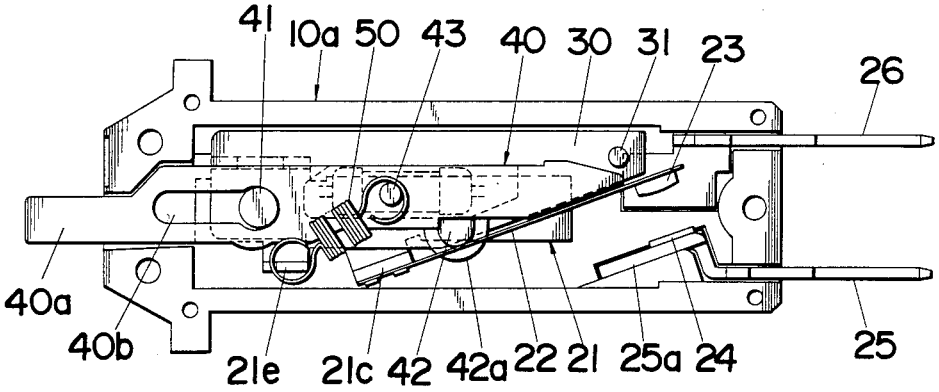
FIG. 5 is a longitudinal sectional view of the circuit breaker in a tripped open contact position.

The actuator 40 is movable between an outward position where it allows the contact spring member 22 to return to its normal position of disengaging the movable contact 23 away from the stationary contact 24 and an inward or set position where it flexes the contact spring member 22 for closing the contacts. As seen from FIGS. 1 and 5, the push-button portion 40*a* is entirely withdrawn in the opening 10*d* at the inward or set position of the actuator 40 and projects outwardly thereof at the outward position of the actuator 40. When the actuator 40 is pushed in against the bias of the return coil spring 50 from the position of FIG. 5 to that of FIG. 1, it moves substantially straight as the downwardly sloping edge 40*d* is guided by the latch pin 31, forcibly flexing the contact spring member 22 against its bias by means of the operator bump 42 sliding along the length of the spring member 22 until the movable contact 23 is in abutting engagement with the stationary contact 24. At this occurrence, the latch pin 31 is latched in the shoulder 40*e* so as to restrain the pivotal movement of the actuator 40 about the pivot pin 41 under the bias of the contact spring means 22 in addition to restraining the sliding movement thereof due to the return coil spring 50, thereby setting the contacts in the closed condition. It is noted here that the contact spring member 22 in the set position always exerts an upward biasing force onto the actuator 40 so as to urge it to pivot in the counterclockwise direction as viewed in FIG. 1. The circuit breaker thus constructed is inserted in the main operating circuit with the actuator 40 set in the inward position to make conductive the internal electrical path.

In operation, when there sees a fault or excessive current greater than a predetermined value flowing through the circuit breaker, the heater resistor 32 responds to radiate heat, which causes to flex the rearward end of the bimetallic strip 30 and the associated latch pin 31 away from the actuator 40, thereby disengaging the latch pin 31 from the shoulder 40*e*. At this occurrence, the actuator 40 is tripped to pivot in the counterclockwise direction under the urgence of the contact spring member 22, allowing the contact spring member 22 to return under its own bias to its normal position of opening the contacts 23 and 24. Immediately after this pivotal movement of the actuator 40, the actuator 40 which is no longer latched is driven to slide back under the bias of the return spring 50 to the outward position of FIG. 5 in which the push-button portion 40*a* projects outwardly of the housing 10 for visual indication of the tripping contact opening. After the bimetallic strip 30 is cooled down to resume its normal position, the latch pin 31 returns to project in the sliding path of the actuator 40 at a location rearwardly adjacent the downwardly sloping edge 40*d* thereof. Thus, resetting of the breaker can be done simply by pushing in the actuator 40 during which manipulation the actuator 40 is moved to the set position with its downwardly sloping edge 40*d* guided by the latch pin 31 in the same manner as described in the above.

Figure 6:
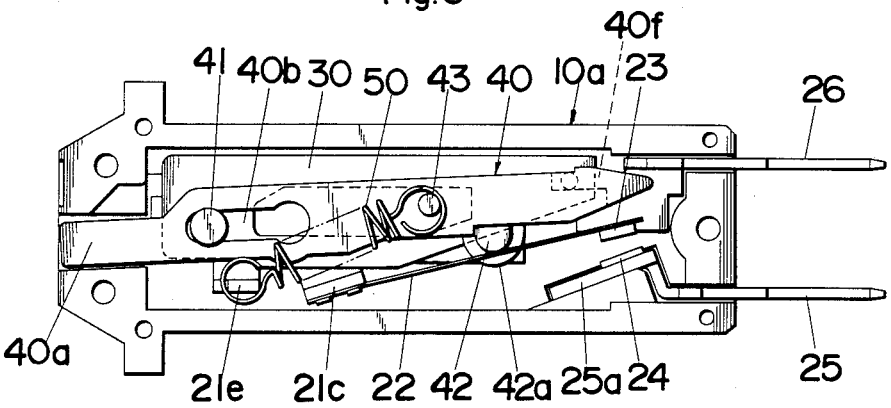
FIG. 6 is a longitudinal sectional view of the circuit breaker in another tripped open contact position.

It is noted at this point that the return spring 50 acts on the actuator 40 to pivot it in the clockwise direction, although the bias thereof is weaker than that of the contact spring member 22. Consequently, when the actuator 40 is tripped to the outward position of FIG. 5, the operator bump 42 is kept in contacting engagement with the contact spring member 22 for positive alignment of the pilot projection 42 with the complementary slit 22*a*, which facilitates the smooth sliding movement of the actuator 40 for translation of the axial movement thereof into the contact closing movement of the contact spring member 22. Also with this action of the return spring 50 the actuator 40 in the outward position can be kept in a correct posture with the tapered rear end located below the latch pin 31 ready for resetting the breaker. Further, it should be noted that the operator bump 42 travels along the contact spring member 22 in constant sliding contact therewith from the fixed end toward the free end of the spring member 22 as the actuator 40 is moved from the outward position to the inward position. In other words, the actuator 40, in its movement to the inward position, gradually and delicately applies the contact closing force to the spring member 22, which is advantageous in effectively preventing the contact spring member 22 from being damaged. Even in a particular installation site where the push button portion 40*a* of the slider 40 is inhibited from protruding through the opening 10*d* of the housing 10 due to an obstacle such as a wall standing close to the circuit breaker, the circuit breaker of the present embodiment can successfully perform its tripping operation to safely open the contacts in the following manner. When the bimetallic strip 30 deforms in response to the fault current condition, the actuator 40 is unlatched from the latch pin to be thereby released to pivot in the counterclockwise direction under the urgency of the contact spring member 22, allowing the contact spring 22 to return under its own bias to its normal position of opening the contacts 23 and 24, while the actuator 40 is inhibited from sliding back to the outward position, as shown in FIG. 6. It is noted here that the counterclockwise movement of the slider 40 is restricted by trapping the latch pin 31 with a stepped portion 40*f* provided in one side of the actuator 40 laterally adjacent the shoulder 40*e*, as best shown in FIG. 6.

Particularly in the present embodiment, the latch pin 31 of the bimetallic strip 30 is in such an advantageous latching engagement with the actuator 40 that the latching force acting on the latch pin 31 will not substantially affect the heat responsive deflecting characteristic of the bimetallic strip 30. To this end, the bimetallic strip 30 has its plane arranged in parallel relation with the plane in which the actuator 40 preforms the pivotal movement and further has th latch pin 31 extending in the direction perpendicular to the plane so that the latching force applied to the latch pin 31 by the contact spring member 22 acts in the direction substantially along the height or width of the bimetallic strip 30 to the bimetallic strip 30, i.e., the direction which the bimetallic strip 30 is most resistive against the deformation. Thus, the bimetallic strip 30 is kept substantially free from being distorted by the latching force resulting from the contact spring member 22, ensuring reliable and accurate tripping operation over a long time service life.

Figure 7:
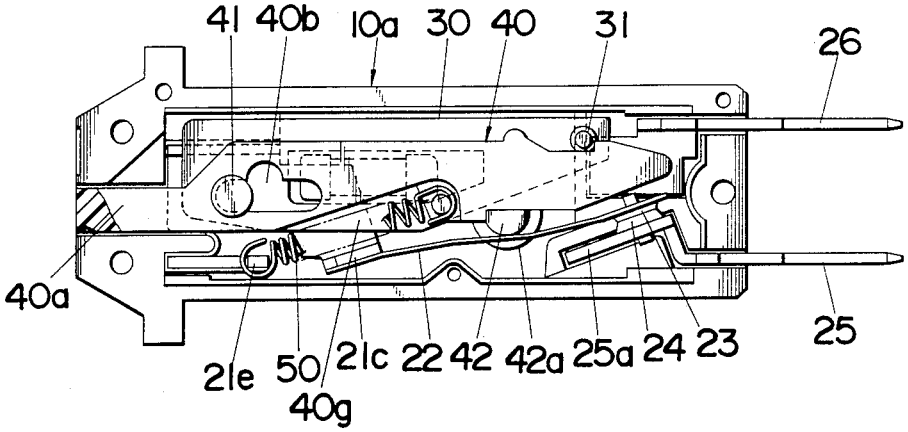
FIG. 7 is a longitudinal sectional view of a circuit breaker in the contact closed position according to a modification of the first preferred embodiment with the half of its housing removed.
Figure 8:
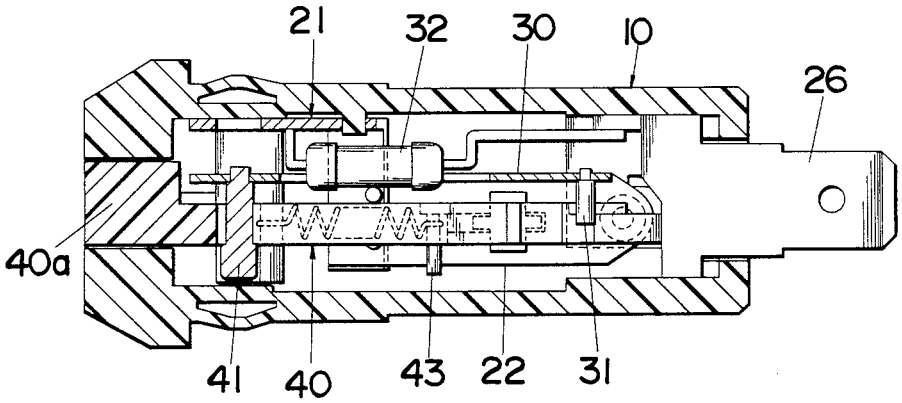
FIG. 8 is a top sectional view of the circuit breaker of FIG. 7.

Referring then to FIGS. 7 and 8, a modification of the first embodiment is shown to have the same construction as the first embodiment except that the connecting ends of the return coil spring 50 with the actuator 40 and the base frame 21 are in longitudinal alignment with the shoulder 40*e* and the pilot projection 42*a*. To this end, the substantial portion of the return spring 50 is received within a recess 40*g* in the lower portion of the actuator 40. With this result, the return spring 50 will exert its spring force only in the lengthwise direction of the actuator 40 and not in the lateral direction, eliminating the twisting of the actuator 40 in its sliding movement and therefore assuring smooth and consistent sliding movement of the actuator 40.

Figure 9:
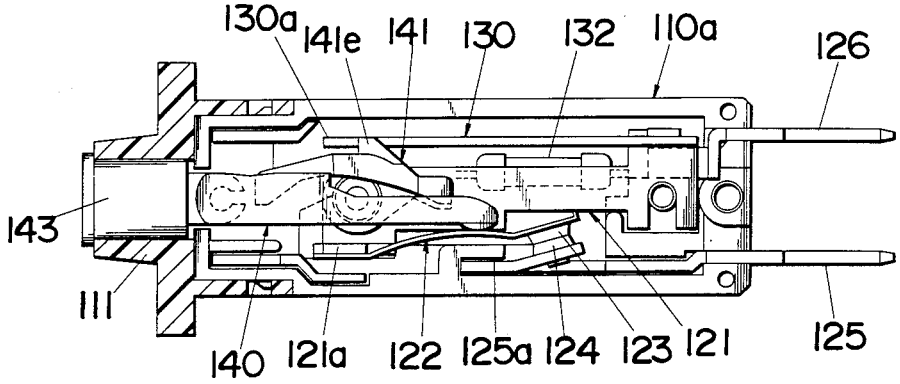
FIG. 9 is a longitudinal sectional view of a circuit breaker in the contact closed position according to a second preferred embodiment of the present invention with the half of its housing removed.
Figure 10:
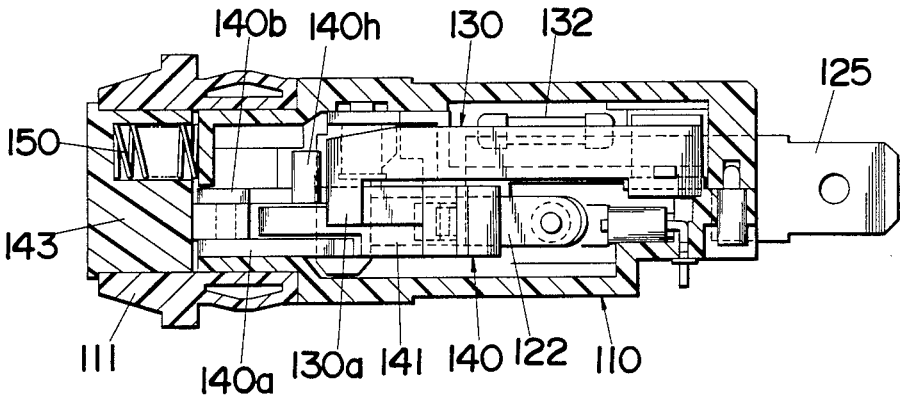
FIG. 10 is a top sectional view of the circuit breaker of FIG. 9.
Figure 11:
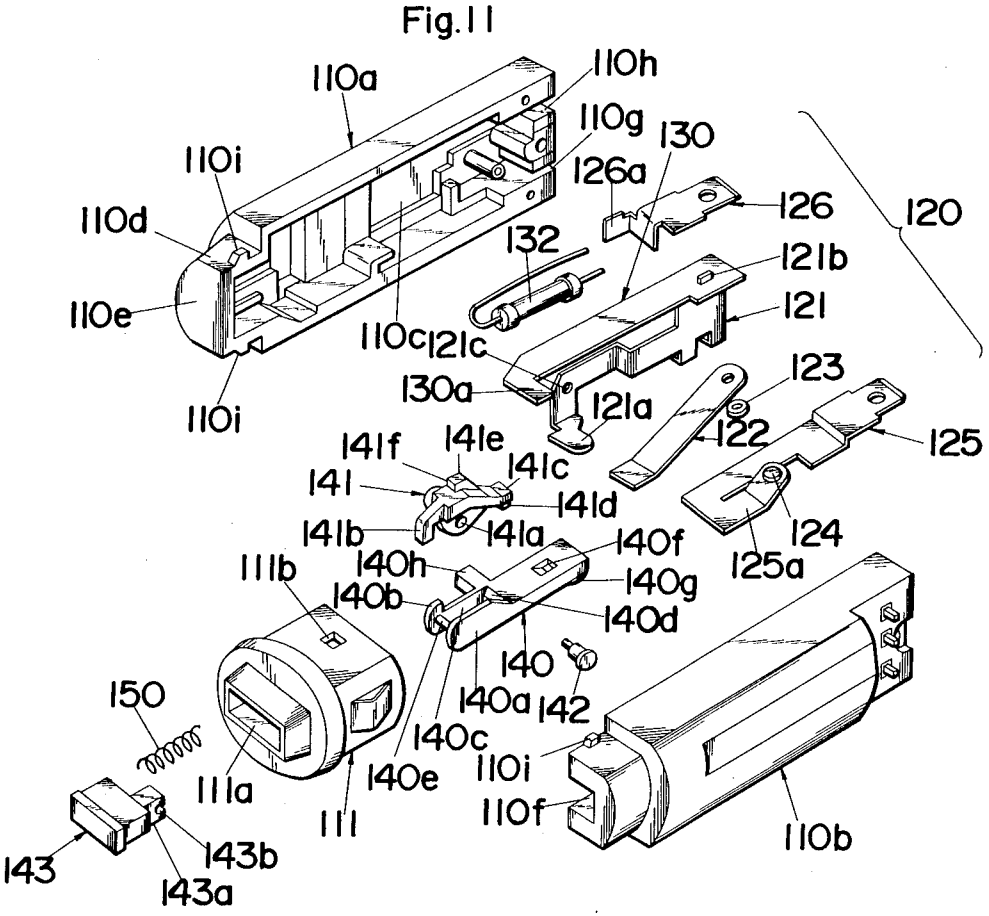
FIG. 11 is an exploded perspective view of the circuit breaker.

Discussion is then made for a second embodiment of the present invention with reference to FIGS. 9 to 15. Referring firstly to FIGS. 9 to 11, the circuit breaker includes an elongated housing 110 having a longitudinal axis. The housing 110 is composed of halves 110*a* and 110*b* molded from an electrically insulating plastic material which are cooperative to define therebetween an elongate cavity 110*c*. The housing 110 is configured to have at its front end a head extension 110*d* with a flat end surface 110*e* and an opening 110*f* and to have at its rear end a pair of spaced slot-like openings 110*g* and 110*h*. The head extension 110*d* has on its upper and lower surfaces respective projections 110*i* for trap engagement with corresponding apertures 111*b* in a cap 111 placed over the head extension 110*d*. The cap 111 has a rectangular opening 111*a* for slidably receiving therein a push-button 143. The cavity 110*c* of the housing 110 is designed to receive a contact assembly 120 including a base frame 121, an elongate contact spring member 122 having its one end fixed to the base frame 121 and carrying a movable contact 123 on the other free end, and a stationary contact 124 disposed in a facing relation with the movable contact 123. The stationary contact 124 is mounted on an internal extension 125*a* of a first terminal 125 trap mounted through the opening 110*g*, while the movable contact 123 is electrically connected by way of the contact spring member 122, the base frame 121 and a heater resistor 132 to an internal extension 126*a* of a second terminal 126 also trap mounted through the opening 110*h* of the housing 110. The contact spring member 122 is operatively connected to an actuator for contact closing and opening, the actuator being composed of a slider 140, a rocker 141 and the push-button 143. A bimetallic strip 130 is also operatively connected to the contact spring member 122 through the actuator for tripping the contact spring member 122 upon the occurrence of the fault current condition.

The contact spring member 122 extends in an inclined relation with respect to the longitudinal axis of the housing 110 with its front end fixedly supported on a lug 121*a* extending laterally from the lower end of the base frame 121. The contact spring member 122 is self-biased in the direction of disengaging the movable contact 123 at its free end from the stationary contact 124. The base frame 121 is provided at its rearmost upper end with a post 121*b* which is press fitted into an aperture at the rear end of the bimetallic strip 130 for supporting the bimetallic strip 1 30 in cantilever fashion. The bimetallic strip 130 is spaced in parallel relation with the substantial portion of the base frame 121 and is integrally formed at its front end with a latch claw 130*a* extending laterally toward the contact spring member 122. Disposed below and in close proximity to the bimetallic strip 130 is the heater resistor 132 which has its ends connected electrically and mechanically to the rear end of the base frame 121 and the internal extension 126*a* of the second terminal 126, respectively. Thus, the internal electrical path is completed from the first terminal 125, through stationary contact 124, movable contact 123, contact spring member 122, base frame 121, heater resistor 131 to the second terminal 126. The heater resistor 132 is also located on the opposite side of the base frame 121 from the contact spring member 122 so as to be separated substantially from the contact spring member 122 by the base frame 121, protecting the heater resistor 132 from a possible arc formed between the separating contacts 123 and 124.

Figure 14:
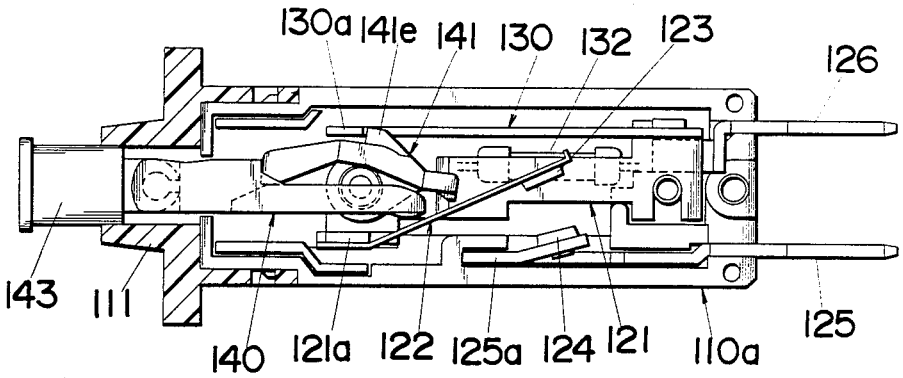
FIG. 14 is a longitudinal sectional view of the circuit breaker in a tripped contact open position.
Figure 12:
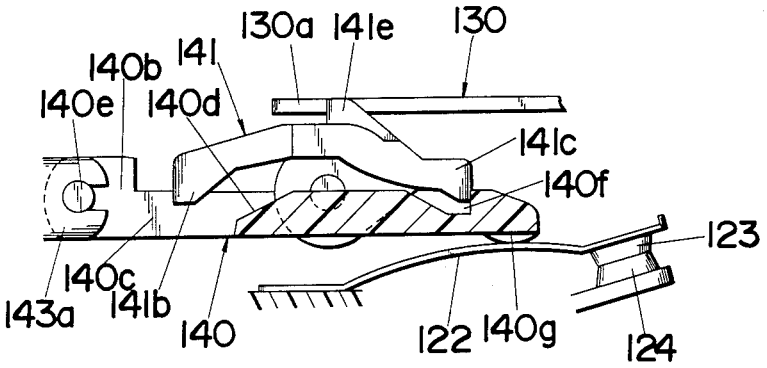
FIG. 12 is an enlarged fragmental view of the circuit breaker in the contact closed position.
Figure 13:
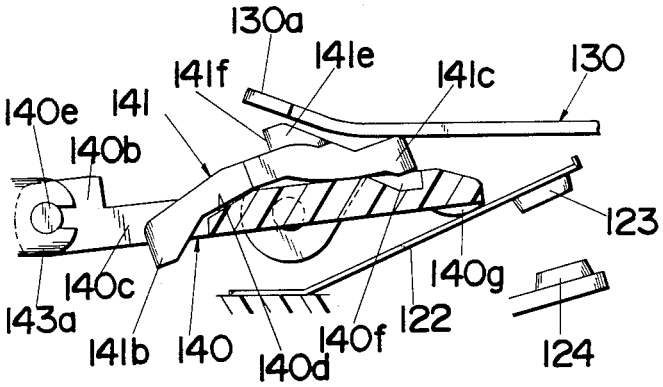
FIG. 13 is an enlarged fragmental view of the circuit breaker illustrating the tripping operation.

The slider 140 of the actuator is pivotally connected at its front end to the push-button 143 by means of a pivot pin 140*e* and is received within the housing 110 to be slidable between an outward position of FIG. 14 and an inward position of FIG. 9. The pivot pin 140*e* is held between a pair of front extensions 140*a* and 140*b* of the slider 140 and snaps into a bearing notch 143*b* in the rearward stem 143*a* of the push-button 143 so that the slider 140 is slidable together with the push-button 143 yet pivotable relative thereto. The slider 140 is urged forward by means of a return spring 150 held between the push-button 143 and the front surface 110*e* of the housing 110, as best shown in FIGS. 10 and 11. A stopper projection 140*h* extends laterally from the middle of the slider 140 in engageable relation with the inner front end of the housing 110 for limiting the forward movement of the slider 140. Formed on the rear lower end of the slider 140 is an operator bump 140*g* which is slidably engaged with the contact spring member 122 for translating the sliding movement of the slider 140 into the contact closing movement of the spring member 122. The slider 140 is operatively connected to the rocker 141 by means of which it is held in the inward position of deflecting the contact spring member 122 against the bias thereof into closed contact condition, as shown in FIGS. 9 and 12. The rocker 141 is pivotally supported about a pivot pin 142 transversely extending through a bearing hole 141*a* of the rocker 141 and having its one end press fitted in a hole 121*c* at the front end of the base frame 121.

Rearwardly and downwardly extending from the rocker 141 is a first arm 141*c* with a catch 141*d* which is engaged with a recess 140*f* in the upper rear of the slider 140 when the slider 140 is moved to the inward position, as best shown in FIG. 12. At this condition, a top projection 141*e* on the rocker 141 is latched at 141*f* by the latch claw 130*a* on the front free end of the bimetallic strip 130 so that the slider 140 and the contact spring member 122 are set in the contact closing position against the bias of the contact spring member 122. Also formed with the rocker 140 is a second arm 141*b* which extends forwardly and downwardly into an opening 140*c* defined between the front extensions 140*a* and 140*b* of the slider 140, the end of the second arm 141*b* being engageable with a slant surface 140*d* at the rear end of the opening 140*c*.

When a fault current flows through the circuit breaker the heater resistor 132 responds to such current flow for radiating heat, which in turn deflects the bimetallic strip 130 upwardly to disengage the latch claw 130*a* from the top projection 141*e* of the rocker 140, releasing the rocker 141. Upon this occurrence, the rocker 141 and the slider 140 are urged under the bias of the contact spring member 122 to pivot in the counterclockwise direction, as viewed in FIG. 13, about the respective pivot pins 142 and 140*e*, allowing the contact spring member 120 to return to its normal position of opening the contacts 123 and 124. Simultaneously or immediately after this tripping, the slider 140 is further urged by the return spring 150 to return to the outward position of FIG. 14 with the push-button 143 projected outwardly of the housing 110. Resetting to the position of FIG. 9 can be made simply by pushing in the slider 140 during which the slider 140 presses down the contact spring member 122 with the operator bump 140*g* for deflecting the contact spring member 122 into contact closing position and is finally engaged at the recess 140*f* with the rocker 141 which is driven to rotate in the clockwise direction due to the cam action between the slant surface 140*d* of the slider 140 and the second arm 141*b* of the rocker 141 being engaged as the slider 140 moves rearward.

Figure 15:
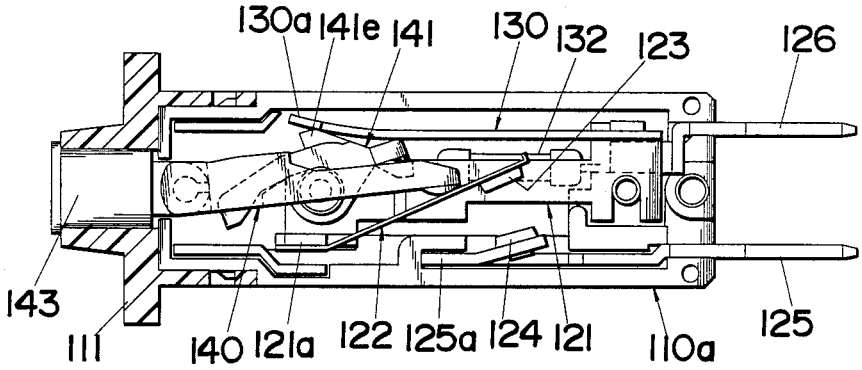
FIG. 15 is a side view of the circuit breaker in another tripped open contact position.

Likewise in the previous embodiment, the circuit breaker of the second embodiment is capable of trip-free contact opening operation even when the slider 140 is restricted from moving back to the outward position in a particular installation site, as shown in FIG. 15. This is because that, as described in the above, the slider 140 can pivot about the pivot pin 140*e* without accompanying the sliding movement when it is urged by the contact spring member 122 in response to the rocker 141 being released or tripped.

Although the above embodiments disclosed only the breaker configuration in which the contact spring member carries directly thereon the movable contacts and is actuated by the sliding movement of the actuator to close the contacts, the present invention should not be limited thereto and may include the breaker configuration, for example, in which a miniature switch having encapsulated internal contacts is incorporated in the breaker housing as the substitution for the set of the movable and stationary contacts and in which the contact spring member is engaged at its free end with an actuator button on the miniature switch in such a relationship as to close the switch when the contact spring member is deflected by the movement of the actuator and to open the switch when the contact spring member is released to its normal position. Also, the heater resistor in the above embodiments may be removed when the bimetallic strip is expected to deflect enough in response to the current directly flowing therethrough. Further, the bimetallic strip can be replaced by a fault current responsive electromagnetic device when rapid interruption is required.

What is claimed is:

1. A circuit braker comprising:

a housing having a longitudinal axis;

contact means mounted within said housing;

an elongate contact spring member mounted within said housing with one end of said contact spring member being fixed and the other end defining a contactor end for driving said contact means, said contact spring member extending in an inclined relationship with respect to said longitudinal axis of said housing and self-biased to move said contactor end in a direction of opening said contact means;

an actuator slidably received in said housing for movement along said longitudinal axis between an outward position and an inward position, said actuator having at one end an operator which abuts on said contact spring member to flex said contact spring member against the bias thereof in a direction of closing said contact means when said actuator is moved to said inward position, said actuator being pivotally supported adjacent the other end so as to be driven counterclockwise by said bias of said contact spring member for pivotal movement about a pivot axis into a set position while keeping said contact means closed;

return spring means for biasing said actuator toward said outward position;

latch means including a latch pin for latching said actuator in said set position against said bias of said contact spring member and said return spring means; and fault current responsive trip means operatively connected to said latch means and including a bimetallic spring fixed at one end and disposed normal to said pivot axis of said actuator, said latch pin being secured to and extending perpendicularly at the other end of said bimetallic strip; said latch pin transferring the force resulting from said bias of said contact spring member substantially in a widthwise direction of said bimetallic strip, whereby, in response to a fault current flow through said closed contact means, said fault current responsive trip means will cause said latch means to unlatch said actuator and permit said actuator to pivot about said pivot axis under said bias of said contact spring member in said direction for opening said contact means to a tripped position where said contact spring member is relaxed and said actuator is permitted to move to said outward position under the bias of said return spring.

2. A circuit breaker as set forth in claim 1, wherein said contact means inlcudes a movable contact on said contact spring member and a stationary contact fixed relative to said housing, said actuator is formed with a latch pin engaging shoulder adjacent said one end and a sloping guide edge leading to said latch pin engaging shoulder and said latch pin cams over said sloping guide edge to engage behind said latch pin engaging shoulder as said actuator is moved from said outward position to said set position, and during said movement said actuator is forced by said latch pin to pivot and flex said contact spring emmber in a direction of engaging said movable contact with said stationary contact.

3. A circuit breaker comprising:

a housing having a longitudinal axis;

contact means mounted within said housing;

an elongate contact spring member mounted within said housing with one end of said contact spring member being fixed and the other end defining a contactor end for driving said contact means, a guide slit formed lengthwise in said contact spring member, said contact spring member extending in an inclined relationship with respect to said longitudinal axis of said housing and self-biased to move said contactor end in a direction of opening said contact means;

an actuator slidably received in said housing for movement along said longitudinal axis between an outward position and an inward position, said actuator having at one end an operator which abuts on said contact spring member to flex said contact spring member against the bias thereof in a direction of closing said contact means when said actuator is moved to said inward position and a pilot projection adjacent said operator and in sliding engagement with said guide slit for guiding said operator along the length of said actuator, said actuator being pivotally supported adjacent the other end so as to be driven counterclockwise by said bias of said contact spring member for pivotal movement about a pivot axis into a set position while keeping said contact means closed;

return spring means for biasing said actuator toward said outward position;

latch means for latching said actuator in said set position against said bias of said contact spring member and said return spring means; and fault current responsive trip means operatively connected to said latch means to cause said latch means to unlatch said actuator in response to a fault current flow through said closed contact means and permit said actuator to pivot about said pivot axis under said bias of said contact spring member in said direction of opening said contact means to a tripped position where said contact spring member is relaxes, and said actuator is permitted to move to said outward position under the bias of said return spring.

4. A circuit breaker as set forth in claim 3, wherein said actuator is formed with a latch pin engaging shoulder and said actuator is connected to one end of said return spring means at a point which is in alignment with said latch pin engaging shoulder and said pilot projection.

5. A circuit breaker comprising:

a housing having a longitudinal axis;

a stationary contact fixed with said housing;

an elongated contact spring member mounted within said housing, one end of said contact spring member being fixed and the other end mounting a movable contact engageable with said stationary contact, said contact spring member extending in an inclined relationship with respect to said longitudinal axis of said housing and self-biased in a direction of disengaging said movable contact from said stationary contact;

an actuator slidably received in said housing for movement along said longitudinal axis between an outward position and an inward position, said actuator having at one end an operator which abuts on said contact spring member to flex said contact spring member against said bias thereof in a direction of engaging said movable contact with said stationary contact when said actuator is moved to said inward position, said actuator being pivotally supported adjacent the other end so as to be driven counterclockwise by said bias of said contact spring member for pivotal movement about a pivot axis into a set position while keeping said stationary and movable contacts engaged;

return spring means for biasing said actuator toward said outward position;

latch means for latching said actuator in its set position against said bias of said return spring means;

fault current responsive trip means operatively connected to said latch means to cause said latch means to unlatch said actuator in response to a fault current flowing through said engaged stationary and movable contacts, permitting said actuator to pivot about said pivot axis under the bias of the contact spring member in a direction releasing said contact spring member into a tripped position to disengage said movable contact from said stationary contact, after which said actuator is permitted to move back to said outward position under the bias of said return spring means;

said fault current responsive trip means comprising a bimetallic strip fixed at one end and disposed normal to said pivot axis of said actuator, a latch pin secured to and projecting perpendicularly from the other end of said bimetallic strip for latching engagement with said actuator with the latching force resulting from the bias of said contact spring member applied to said bimetallic strip substantially in a widthwise direction of the bimetallic strip;

said actuator being formed adjacent said latch pin with a sloping guide edge leading to a latch pin engaging shoulder, said latch pin camming over the said sloping guide edge and being locked behind said shoulder as said actuator is moved from said outward position to said set position, during which movement said actuator is forced by said latch pin to pivot and flex said contact spring member in a direction for engaging said movable contact with said stationary contact;

said contact spring member being formed with a guide slit extending lengthwise thereof; and said actuator being formed adjacent said operator with a pilot extension in sliding engagement with said guide slit extending lengthwise in said contact spring member for guiding said operator along the length of said contact spring member as said actuator is moved from said outward position to said set position.

6. A circuit breaker comprising:

a housing having a longitudinal axis;

a stationary contact fixed within said housing;

an elongated contact spring member mounted within said housing, one end of said contact spring member being fixed to said housing and the other end mounting a movable contact engageable with said stationary contact, said contact spring member extending in an inclined relationship with respect to said longitudinal axis of said housing and self-biased in a direction of disengaging said movable contact from said stationary contact;

an actuator received in said housing and operatively connected to said contact spring member for closing said stationary and movable contacts, said actuator comprising a slider and a rocker engageable with each other, said slider being slidable for movement along the longitudinal axis of said housing between an outward position and a inward position, said slider having at one end an operator which abuts said contact spring member to flex said contact spring member against the bias thereof in a direction of engaging said movable contact with said stationary contact when said slider is moved to said inward position, said slider being pivotally supported at the other end so as to be counter-driven by the bias of said contact spring member to pivot about a first pivot axis for pivotal movement into a set position while keeping said movable and stationary contacts engaged, said rocker being pivotable about a second pivot axis and engaged with said slider when said slider is moved to said inward position at which position said rocker is biased together with said slider by said contact spring member to pivot about said second pivot axis into latching engagement with latching means while being engaged with said slider to restrict said slider in its set position;

return spring means for biasing said slider toward said outward position; and fault current responsive trip means operatively connected to the latching means to cause said latching means to unlatch said rocker in response to a fault current flowing through said engaged movable and stationary contacts, permitting said rocker to pivot about said second pivot axis under the bias of said contact spring member to relase said slider and thereby permitting said slider to pivot about said first pivot axis under the bias of said contact spring member in a direction of releasing said contact spring member into a tripped position to disengage said movable contact from said stationary contact, after which said slider is permitted to move back to said outward position under the bias of said return spring means.

7. A circuit breaker as set forth in claim 6, wherein said slider comprises a button and a main slider body which are pivotally connected to each other by means of a pivot pin defining said first pivot axis.

8. A circuit breaker comprising:

a housing having a longitudinal axis;

contact means mounted within said housing;

an elongate contact spring member mounted within said housing with one end of said contact spring member being fixed and the other end defining a contactor end for driving said contact means, said contact spring member extending in an inclined relationship with respect to said longitudinal axis of said housing an self-biased to move said contactor end in a direction of opening said contact means;

an actuator slidably received in said housing for movement along said longitudinal axis between an outward position and an inward position, said actuator having at one end an operator which abuts on said contact spring member to flex said contact spring member against the bias thereof in a direction of closing said contact means when said actuator is moved to said inward position, said actuator being pivotally supported adjacent the other end so as to be driven counterclockwise by said bias of said contact spring member for pivotal movement about a pivot axis into a set position while keeping said contact means closed;

return spring means for biasing said actuator toward said outward position;

a base frame received in said housing for mounting a pivot pin defining said pivot axis for said actuator, one end of said return spring means being connected to a portion of said base frame, said actuator being formed with an elongated slot within which said pivot pin is slidably received for permitting said actuator to be slidable for movement between said outward position and said inward position and to be pivotable about said pivot axis for movement to said set position;

latch means for latching said actuator in said set position against said bias of said contact spring member and said return spring means; and fault current responsive trip means operatively connected to said latch means and including a bimetallic strip fixed at one end to said base frame, said fault current responsive trip means being adapted to cause said latch means to unlatch said actuator in response to a fault current flow through said closed contact means and permit said actuator to pivot about said pivot axis under said bias of said contact spring member in said direction of opening said contact means to a tripped position where said contact spring member is relaxes and said actuator is permitted to move to said outward position under the bias of said return spring means.

* * * * *